US008308580B2

(12) United States Patent
Jasinski

(10) Patent No.: US 8,308,580 B2
(45) Date of Patent: Nov. 13, 2012

(54) GOLF ALIGNMENT AND POSTURE TRAINING DEVICE

(76) Inventor: Raymond Felix Jasinski, Chapel Hill, NC (US)

( * ) Notice: Subject to any disclaimer, the term of this patent is extended or adjusted under 35 U.S.C. 154(b) by 0 days.

(21) Appl. No.: 13/103,973

(22) Filed: May 9, 2011

(65) Prior Publication Data

US 2011/0275447 A1 Nov. 10, 2011

Related U.S. Application Data

(60) Provisional application No. 61/395,136, filed on May 7, 2010.

(51) Int. Cl.
*A63B 69/36* (2006.01)

(52) U.S. Cl. ..... 473/271; 473/257; 473/276

(58) Field of Classification Search ..... 473/207, 473/211, 212, 219, 227, 257, 258, 266, 270–276
See application file for complete search history.

(56) References Cited

U.S. PATENT DOCUMENTS

| | | | | |
|---|---|---|---|---|
| 1,936,143 | A | 11/1933 | Shea | |
| 4,993,716 | A * | 2/1991 | Waller | 473/275 |
| 6,343,998 | B1 | 2/2002 | Tarulli et al. | |
| 6,595,865 | B2 | 7/2003 | Stitz | |
| 6,723,003 | B1 * | 4/2004 | Harrell | 473/270 |
| 6,932,712 | B2 * | 8/2005 | Cardosi | 473/261 |
| 7,025,689 | B2 | 4/2006 | Infalt | |
| 7,150,683 | B2 | 12/2006 | Bender | |
| 7,204,766 | B1 | 4/2007 | Rose et al. | |
| 7,273,416 | B2 | 9/2007 | Peek | |
| 7,651,406 | B1 * | 1/2010 | Yeh | 473/266 |
| 7,708,650 | B2 | 5/2010 | Lloyd | |
| 7,727,082 | B2 | 6/2010 | Larsen | |

* cited by examiner

*Primary Examiner* — Nini Legesse
(74) *Attorney, Agent, or Firm* — Jenkins, Wilson, Taylor & Hunt, P.A.

(57) ABSTRACT

A golf alignment and posture training device is disclosed. According to one aspect, the subject matter described herein includes a golf training device for indicating a proper stance, including posture and alignment, of a golfer who is positioned in preparation for hitting a golf ball prior to taking a swing. The device includes a shoulder positioning member for indicating a desired stance of a golfer prior to taking a swing, including a desired position of each of the golfer's shoulders relative to the position and/or the intended trajectory of the ball, and a support structure for positioning the shoulder positioning member in a first position and a second position. In the first position, the desired position of the golfer's shoulders is indicated by contact of the golfer's shoulder area with the shoulder positioning member, and, in the second position, the shoulder positioning member is located away from the first position such that the shoulder positioning member does not interfere with the swing when it is taken.

25 Claims, 8 Drawing Sheets

GOLF ALIGNMENT AND POSTURE TRAINING DEVICE

PRIORITY CLAIM

This application claims the benefit of U.S. Provisional Patent Application Ser. No. 61/395,136, filed May 7, 2010, the disclosure of which is incorporated herein by reference in its entirety.

TECHNICAL FIELD

The subject matter described herein relates to golf training aids. More particularly, the subject matter described herein relates to a golf alignment and posture training device.

BACKGROUND

Golfers seek to improve their golf game and golf scores by developing a proper swing and by practicing that swing repeatedly in order to improve consistency. In order to consistently perform a proper swing, the golfer must consistently assume the proper stance prior to the swing. A proper stance includes proper position of the golfer relative to the ball, proper posture of the golfer, and proper alignment of the golfer's body in preparation for taking the swing. There are multiple factors that make up proper posture and alignment. One factor is the position of the golfer's shoulders relative to the position or intended trajectory of the ball prior to the swing.

Some conventional golf training aids are designed to indicate proper body motion during the swing, such as training aids that are attached to the golfer's body and move with the golfer's body during the swing, and training aids that do not touch the golfer's body but are positioned close to the golfer's body so that an improper swing is indicated by contact or collision with the training aid during the swing. The former type are cumbersome and the latter type have the potential to cause injury due to contact with the device. Other conventional golf training aids are designed to indicate proper body position prior to the swing, but the device impedes the golf swing and so the golfer must move away from the positioning aid before taking a swing, which can cause the golfer to lose the desired stance and position.

Accordingly, in light of these disadvantages associated with conventional golf training devices, there exists a need for an improved golf alignment and posture training device.

SUMMARY

According to one aspect, the subject matter described herein includes a golf training device for indicating proper stance, including posture and alignment, of a golfer who is positioned in preparation for hitting a golf ball prior to taking a swing. The device includes a shoulder positioning member for indicating a desired stance of a golfer prior to taking a swing, including a desired position of each of the golfer's shoulders relative to at least one of the position of the ball and the intended trajectory of the ball, and a support structure for positioning the shoulder positioning member in a first position and a second position. In the first position, the desired position of the golfer's shoulders is indicated by contact of the golfer's shoulder area with the shoulder positioning member, and in the second position, the shoulder positioning member is located away from the first position such that the shoulder positioning member does not interfere with the swing when it is taken. The shoulder positioning member is moveable from the first position to the second position without requiring movement of the golfer's shoulders away from the desired position that was established prior to taking the swing. The device is adjustable to accommodate different sized golfers, different sized clubs used by a golfer, or different stances desired by a golfer using a particular club. In one embodiment, markings or other indicia on the device allow the adjustments to be repeatable.

BRIEF DESCRIPTION OF THE DRAWINGS

Preferred embodiments of the subject matter described herein will now be explained with reference to the accompanying drawings, wherein like reference numerals represent like parts, of which.

DETAILED DESCRIPTION

In accordance with the subject matter disclosed herein, a golf training device for indicating proper stance, including posture and alignment, of a golfer who is positioned in preparation for hitting a golf ball prior to taking a swing is herein described. In one embodiment, the device includes a shoulder positioning member for indicating a desired stance of a golfer prior to taking a swing, including a desired position of each of the golfer's shoulders relative to at least one of the position of the ball and the intended trajectory of the ball, and a support structure for positioning the shoulder positioning member in a first position and a second position. In the first position, the desired position of the golfer's shoulders is indicated by contact of the golfer's shoulder area with the shoulder positioning member. In the second position, the shoulder positioning member is located away from the first position such that the shoulder positioning member does not interfere with the swing when it is taken. The shoulder positioning member is moveable from the first position to the second position without requiring movement of the golfer's shoulders away from the desired position that was established prior to taking the swing. The golf training device is adjustable to accommodate different sized golfers, different sized clubs used by a golfer, or different types of stances (e.g., open, closed, square) that may be taken by the golfer prior to the swing. Reference will now be made in detail to exemplary embodiments of the present invention, examples of which are illustrated in the accompanying drawings. Wherever possible, the same reference numbers will be used throughout the drawings to refer to the same or like parts.

Figure 1:
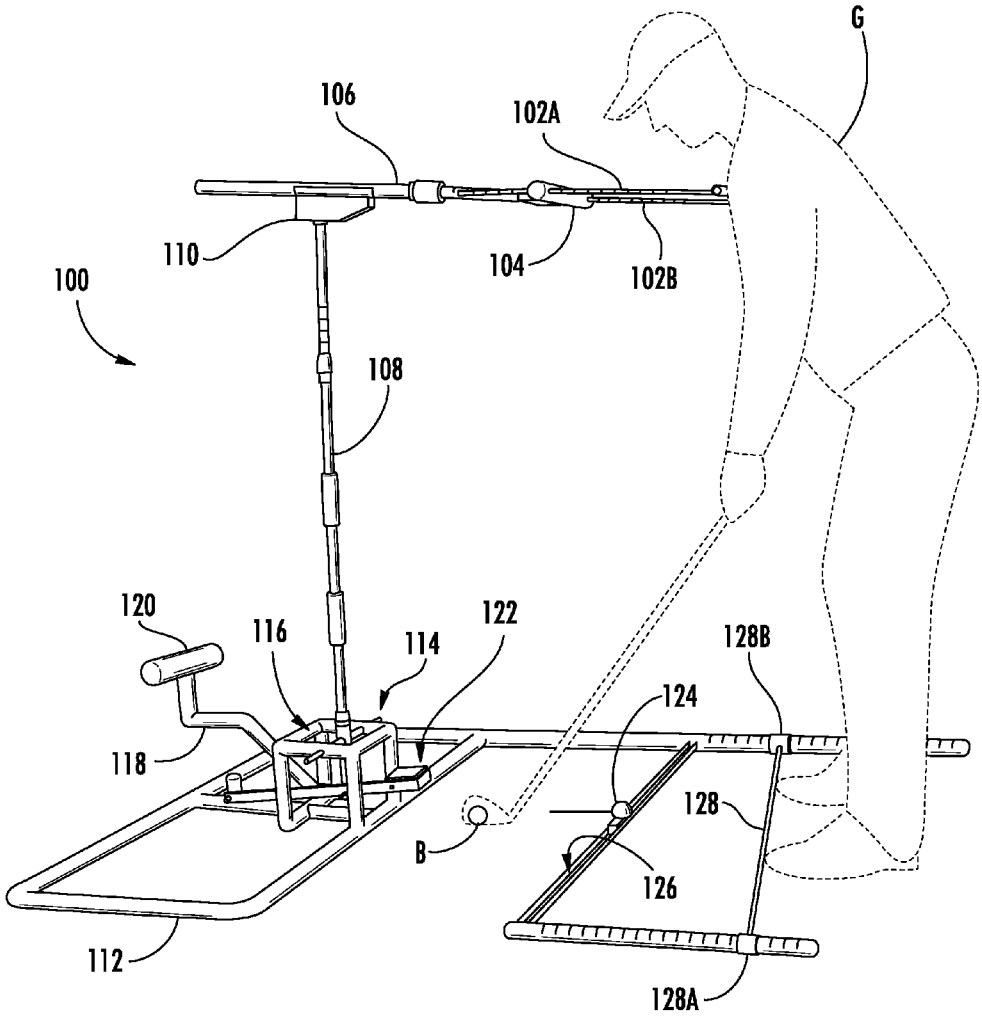
FIG. 1 is an isometric view of a golf training device according to an embodiment of the subject matter described herein, showing a shoulder positioning member in a first position, in which the desired position of the golfer's shoulders is indicated by contact of the golfer's shoulder area with the shoulder positioning member.
Figure 2:
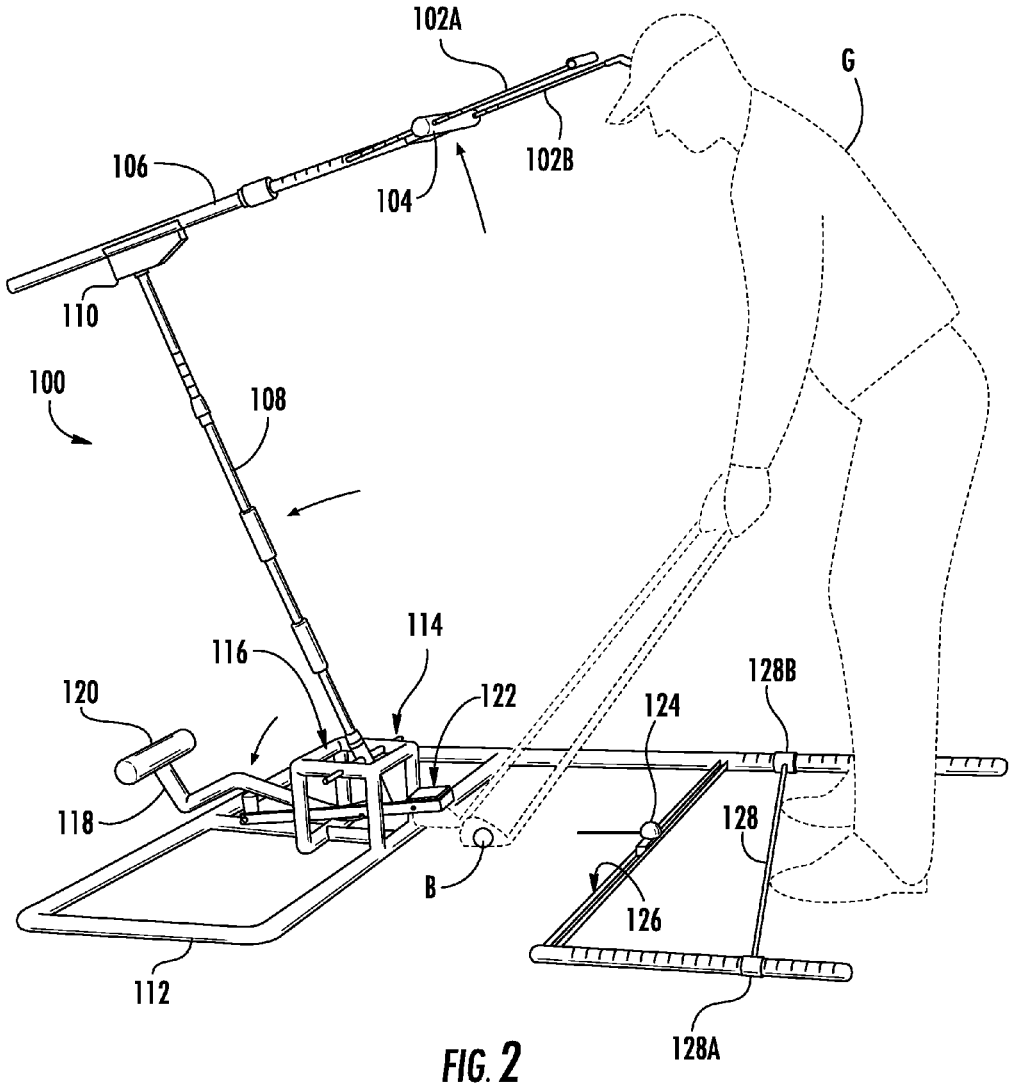
FIG. 2 is an isometric view of a golf training device according to an embodiment of the subject matter described herein, showing a shoulder positioning member in a second position, in which the shoulder positioning member is located away from the first position such that the shoulder positioning member does not interfere with the swing when it is taken.

FIGS. 1 and 2 are isometric views of a golf training device 100 for indicating proper stance, including posture and alignment, of a golfer G who is positioned in preparation for hitting a golf ball B prior to taking a swing according to an embodiment of the subject matter described herein. Device 100 includes a shoulder positioning member for indicating a desired stance of a golfer prior to taking a swing, including a desired position of each of the golfer's shoulders relative to the position of the ball or the intended trajectory of the ball, and a support structure for positioning the shoulder positioning member in a first position and a second position. FIG. 1 shows device 100 with the shoulder positioning member in the first position, and FIG. 2 shows device 100 with the shoulder positioning member in the second position.

In the embodiment illustrated in FIGS. 1 and 2, the shoulder positioning member includes two shoulder position indicators 102A and 102B that are attached to a generally U-shaped yoke 104, where the shoulder position indicators 102A and 102B are the legs of the U shape and the portion of the U shape between the legs, herein referred to as the base of the U shape, is attached to a horizontal support member 106. The generally U-shaped yoke allows the shoulder position indicators 102A and 102B to make contact with the front part of the golfer's shoulders rather than the golfer's chest, head, or chin. Shoulder position indicators 102A and 102B may be adjusted to be a sufficient distance from the centerline of the golfer's body so that when the shoulder positioning member moves up and out of the way during a transition from the first position to the second position, the golfer can maintain the proper stance and position and does not have to move his or her arms, shoulders, head, or any other part of the body. In one embodiment, the width or depth of the U-shape may be adjustable.

In one embodiment, horizontal support member 106 is attached to a vertical support member 108. In the embodiment illustrated in FIGS. 1 and 2, horizontal support member 106 is attached to a vertical support member 108 via a mount 110.

The support structure includes a base 112 having a pivot 114 that supports vertical support member 108 and allows vertical support member 108 to tilt or pivot towards golfer G or away from golfer G, to place the shoulder positioning member (e.g., shoulder position indicators 102A and 102B) into the first and second positions, respectively. In the embodiment illustrated in FIGS. 1 and 2, pivot 114 is an axle through vertical support member 108, the axle supported by a box frame 116 such that a portion of vertical support member 108 extends below the axle and out of box frame 116, away from golfer G. This portion is referred to as the "tail" 118 of vertical support member 108.

In one embodiment, a weight or counterweight may provide the motive force to move the shoulder positioning member from the first position to the second position. For example, in the embodiment illustrated in FIGS. 1 and 2, a counterweight 120 is attached to the portion of vertical support member 108 that extends below the axle. Counterweight 120 balances the weight of shoulder position indicators 102A and 102B, the yoke 104, and the horizontal support member 106. In one embodiment, counterweight 120 may provide enough downward force on tail 118 to cause the portion of vertical support member 108 above pivot axle 114 to rotate away from golfer G and thus move the shoulder positioning member assembly away from golfer G, i.e., to move the shoulder positioning member from the first position to the second position.

In one embodiment, the weight of components of device 100 may cause shoulder position indicators 102A and 102B to fall away from golfer G, i.e., to move from first position to the second position. For example, pivot 114 may be located at the very bottom of a vertical support member 108 that is tilting away from golfer G even in the first position, causing the center of gravity of the shoulder position member to be located on the other side of pivot point 114 from golfer G, such that when released, gravity causes vertical support member 108 to move away from golfer G, along with shoulder position indicators 102A and 102B.

In one embodiment, the golfer may use a golf club to simply push vertical support member 108 away from the golfer, which moves the shoulder positioning member from the first position to the second position. This can be done while the golfer maintains the desired stance, including shoulder positions, i.e., it does not require the golfer to move away from the device or otherwise change the golfer's position that was established while the shoulder positioning member was in the first position.

In alternative embodiments, this motive force may be provided by a spring or elastic member, by a hydraulic or pneumatic piston, by an electric motor, or other means. Alternative embodiments are illustrated in more detail in FIGS. 6 and 7, which will be described below.

In one embodiment, base 112 includes a locking and release mechanism 122 for locking the shoulder positioning member into the first position while golfer G positions his or her shoulders against shoulder position indicators 102A and 102B. Once the desired position is attained, golfer G uses locking and release mechanism 122 to release the shoulder positioning member from the first position and allow the shoulder positioning member to move from the first position to the second position. One embodiment of locking and release mechanism 122 is illustrated in more detail in FIG. 5, which will be described below.

Shoulder position indicators 102A and 102B are adjustable to position each of the golfer's shoulders relative to the position or intended trajectory of ball B prior to the swing. Some examples of adjustments are illustrated in FIGS. 3 and 4, which will be described below.

In one embodiment, device 100 may include various visual aids to help indicate a proper stance and position of golfer G relative to the position or intended trajectory of ball B. In the embodiment illustrated in FIGS. 1 and 2, for example, base 112 may include a ball position indicator 124 for indicating the desired position of ball B relative to the golfer's shoulders. This is useful to indicate a desired position of ball B relative to the centerline of golfer G. In the embodiment illustrated in FIG. 1, ball position indicator 124 is adjustable from left to right relative to golfer G. In one embodiment, base 112 includes a track or groove 126 within which ball position indicator can slide. In one embodiment, the track or groove 126 may be marked with numbers, letters, lines, or other indicia to allow the golfer to place ball position indicator 124 into a position appropriate for the golfer, the club being used by the golfer, and so on.

In one embodiment, base 112 includes a foot position indicator 128 for indicating the proper placement of the golfer's feet prior to taking the swing. In the embodiment illustrated in FIGS. 1 and 2, foot position indicator 128 may be a bar or cord 128 having ends 128A and 128B that can be independently positioned on or along separate rails of base 112. In this manner, the position and angle of foot position indicator 128 may be adjusted for an open, closed, or square stance, and may be moved closer to or farther from ball B as appropriate for the particular golfer and/or golf club being used.

Figure 3:
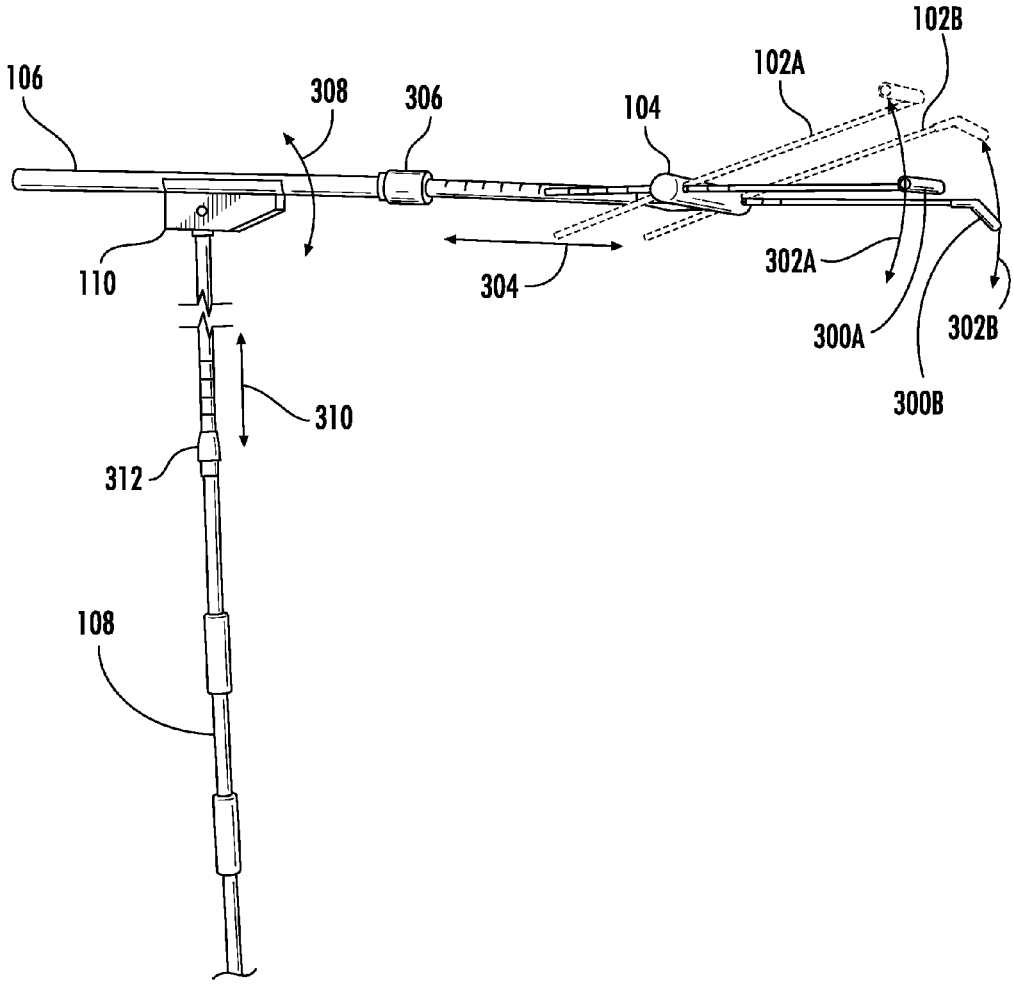
FIG. 3 is a detail view of a shoulder positioning member according to an embodiment of the subject matter described herein, showing example adjustments that can be made to accommodate different golfers and different positions of a golfer.
Figure 4:
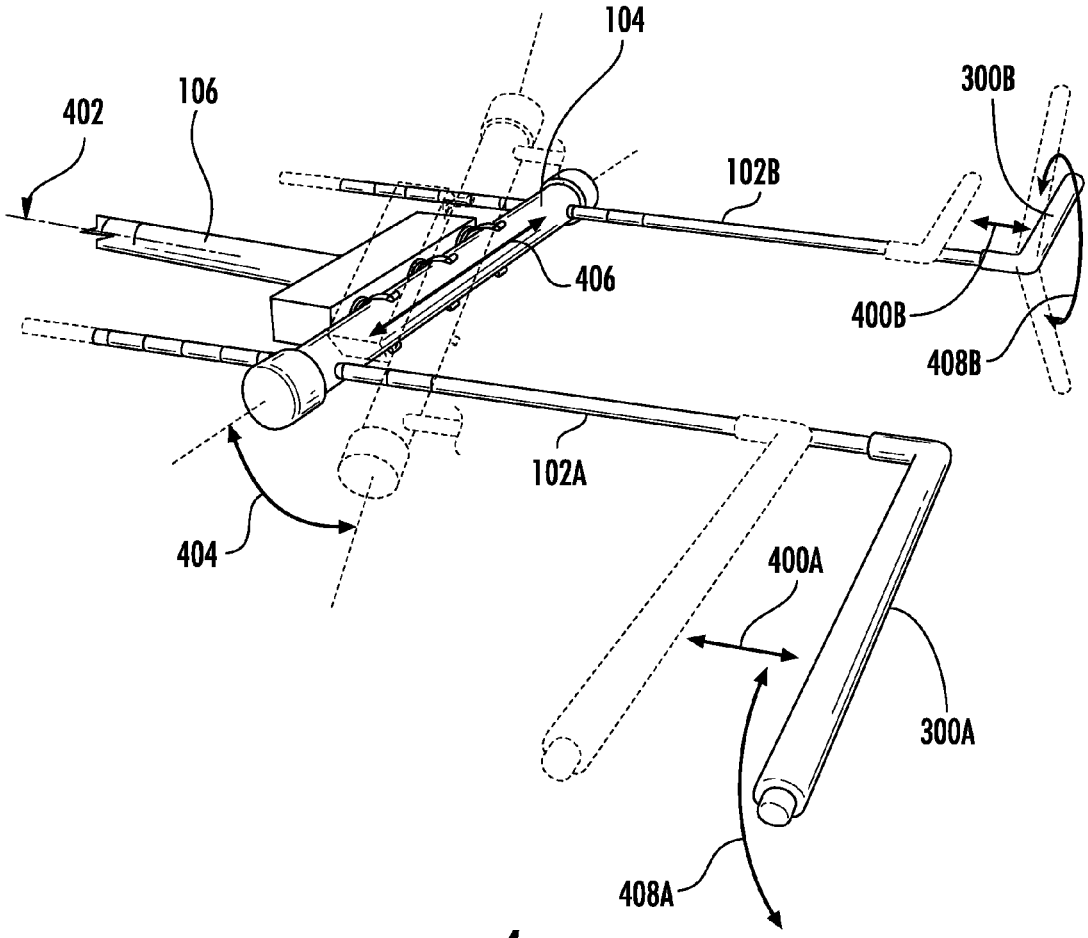
FIG. 4 is a detail view of a shoulder positioning member according to an embodiment of the subject matter described herein, showing other example adjustments that can be made to the shoulder positioning member.

FIG. 3 is a detail view of a golf training device according to an embodiment of the subject matter described herein. In one embodiment, shoulder position indicators 102A and 102B each have a contact area, 300A and 300B, respectively, for contacting a golfer's left and right shoulder areas separately. Contact areas 300A and 300B may be padded or semi-rigid for comfort, and they may be straight or contoured for comfort. The angle of shoulder position indicators 102A and 102B relative to yoke 104 and/or the ground are separately and individually adjustable. In the embodiment illustrated in FIG. 3, each shoulder positioning member 102A and 102B can independently tilt up or down relative to yoke 104, as shown by arrows 302A and 302B. In an alternative embodiment, yoke 104 may rotate around an axis of rotation extending through the length of the yoke 110, i.e., perpendicular to an axis extending the length of horizontal support member 106, such that shoulder position indicators 102A and 102B tilt up or down relative to horizontal support member 106. This allows the height of contact areas 300A and 300B to be set relatively higher or lower than the height of yoke 104. For example, yoke 104 could be set high relative to the height of contacts areas 300A and 300B so as to move yoke 104 out of the golfer's field of view while the golfer is in the pre-swing stance. Alternatively, yoke 104 could be set low relative to the height of contacts areas 300A and 300B so as to avoid interference between yoke 104 and any headgear worn by the golfer.

In one embodiment, the length of horizontal support member 106 is adjustable so as to move yoke 104 and shoulder position indicators 102A and 102B farther from or closer to vertical support member 108 and consequently farther from or closer to ball B. This allows a proper stance to be indicated for golfers with different arm lengths or for a golfer who is using different length clubs. In one embodiment, horizontal support member 106 includes a sliding extension that can be locked into position. In the embodiment illustrated in FIG. 3, for example, horizontal support member 106 includes a set of nested tubes or cylinders, where the outside cylinder of horizontal support member 106 is mounted to vertical support member 108, and an inside cylinder of horizontal support member 106 slides out of and into the outside cylinder to extend towards or away from golfer G, respectively, as shown by arrow 304. In one embodiment, a twist-lock, thumbscrew, clamp, or other locking mechanism 306 secures the length of horizontal support member 106 by securing the positions of the outer and inner cylinders relative to each other. In alternative embodiments, the length horizontal support member 106 may be adjusted by other means such as other types of sliding structures, structures having threaded components that extend or retract by twisting, structures having bearings or sleeves, structures that extend using hinges or pantographs, structures in which extension pieces are added or removed, etc. Other embodiments that allow adjustment of the length of horizontal support member 106 are within the scope of the subject matter described herein.

In the embodiment illustrated in FIG. 3, horizontal support member 106 is attached to vertical support member 108 via a mount 110. In one embodiment, mount 110 attaches horizontal support member 106 to vertical support member 108 at a fixed angle. In an alternative embodiment, mount 110 may be configured to allow the angle between horizontal support member 106 and vertical support member 108 to be changed, as shown by arrow 308.

In one embodiment, vertical support member 108 has adjustable length, which allows the heights of horizontal support member 106, yoke 104, and shoulder position indicators 102A and 102B to be adjusted for a particular golfer. In the embodiment illustrated in FIG. 3, vertical support member 108 includes a set of nested tubes or cylinders, where the outside cylinder of vertical support member 108 is mounted to base 112 and an inside cylinder of vertical support member 108 slides out of and into the outside cylinder to raise or lower the height of shoulder positioning member 102 relative to base 112, as shown by arrow 310. In one embodiment, a twist-lock, thumbscrew, clamp, or other locking mechanism 312 secures the length of vertical support member 108 and thereby secures the height of shoulder position indicators 102A and 102B. In alternative embodiments, the length of vertical support member 108 may be adjusted by means of other types of sliding structures, structures having threaded components that extend or retract by twisting, structures having bearings or sleeves, structures that extend using hinges or pantographs, structures in which extension pieces are added or removed, etc. Other embodiments that allow adjustment of the length of vertical support member 108 are within the scope of the subject matter described herein.

The support structure for positioning the shoulder positioning member in a first position and a second position is not limited to embodiments which use separate horizontal and vertical supports. Likewise, the support structures may be rigid or flexible. In an alternative embodiment, for example, a single straight or curved support may connect shoulder position indicators 102A and 102B to base 112. In one embodiment, this curved support may be made of a flexible, elastic, or spring-like material that is compressed or flexed in the first position and, upon release from the first position, decompresses or un-flexes, thereby returning to the second position. In an alternative embodiment, shoulder position indicators 102A and 102B may move from the first position to the second position by translation, rotation, or a combination of the above.

FIG. 4 illustrates additional adjustments that may be made to the positions of shoulder position indicators 102A and 102B according to an embodiment of the subject matter described herein. In the embodiment illustrated in FIG. 4, each shoulder positioning member 102A and 102B may be separately and independently adjusted relative to yoke 104. For example, each shoulder positioning member 102 may slide through yoke 104 such that the shoulder positioning member's respective shoulder contact area 300 moves toward or away from golfer G, as shown by arrows 400A and 400B. In this manner, device 100 may be used to indicate a stance in which the golfer's shoulders are not the same distance from the ball, e.g., an "open" or "closed" stance, as well as a stance in which the golfer's shoulders are the same distance from the ball, e.g., a square or neutral stance. In one embodiment, each shoulder position indicator 102 is secured to yoke 104 by a locking device, such as a clamp, thumbscrew, or the like. In one embodiment, yoke 104 is a hollow tube containing a compression spring that presses shoulder position indicators 102A and 102B against the body of yoke 104, thereby securing shoulder position indicators 102A and 102B into place by friction.

In an alternative embodiment, shoulder position indicators 102A and 102B may be of a fixed length and attached to a generally U- or C-shaped yoke that rotates around a vertical axis that is located somewhere between the ends of the yoke and that is fixed to the end of horizontal support member 106. Other embodiments that allow contact areas 300A and 300B to be set to different distances relative to the position or intended trajectory of ball B are within the scope of the subject matter described herein.

In one embodiment, yoke 104 can rotate around an axis 402 through the length of horizontal support member 106, as shown by arrow 404. This rotation allows the height of contact area 300A to be different from the height of contact area 300B. This is useful when a golfer desires a stance in which the golfer's spine is curved or tilted to one side or the other rather than straight up, or in which one shoulder is higher than the other. Other embodiments that allow contact areas 300A and 300B to be set to different heights relative to each other are within the scope of the subject matter described herein.

In one embodiment, the position of yoke 104 relative to the end of horizontal support member 106 may be adjustable. In the embodiment illustrated in FIG. 4, for example, yoke 104 can be moved from side to side from the perspective of a golfer facing yoke 104, as shown by arrow 406. This is useful to allow a golfer's shoulders to be centered over one point on the ground underneath the golfer while the golfer's hips or feet are centered over another point on the ground underneath the golfer, e.g., where in the desired stance the golfer leans to the left or right relative to the position of the golfer's feet.

In one embodiment, each of shoulder position indicators 102A and 102B may be independently rotated along an axis through the portion of the shoulder positioning member that is normal to surface of yoke 104. In the embodiment illustrated in FIG. 4, this rotation is shown by arrows 408A and 408B. This allows contacts areas 300A and 300B to be adjusted for the individual golfer's comfort.

Figure 5:
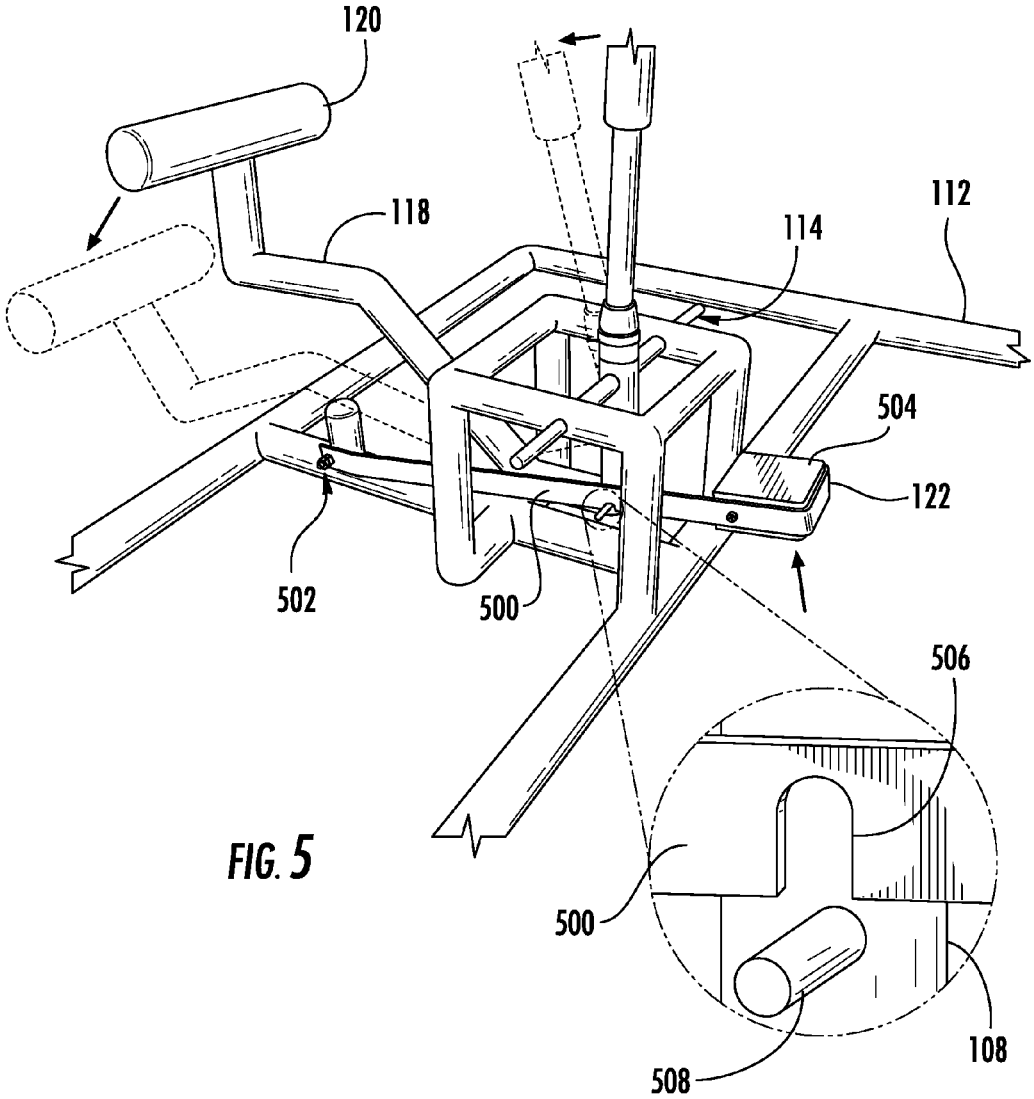
FIG. 5 is a detail view of a locking mechanism component of the support structure for supporting a shoulder positioning member according to an embodiment of the subject matter described herein.

FIG. 5 is a detail view of a locking mechanism component of the support structure for supporting a shoulder positioning member according to an embodiment of the subject matter described herein. In the embodiment illustrated in FIG. 5, locking and release mechanism 122 includes a lever arm 500 having a hinge or pivot 502 at one end, with which lever 500 is attached to base 112, and having a weight 504 on the other end. A notch 506 in lever arm 500 engages a pin 508 on the side of vertical support member 108, preventing vertical support member 108 from rotating around pivot 114 and thus locking vertical support member 108 and attached shoulder position indicators 102A and 102B into the first position. To release vertical support member 108 and allow vertical support member 108 to rotate and move shoulder position indicators 102A and 102B into the second position, golfer G may use a club to raise the weighted end 504 of lever arm 500 so that notch 506 no longer engages pin 508, allowing the portion of vertical support member 108 above pivot 114 to rotate or tilt away from golfer G. In an alternative embodiment, a spring may be used rather than weight 504 to push lever arm 500 downwards so that notch 506 engages pin 508 on the side of vertical support member 108. Other embodiments of a locking and release mechanism are also considered to be within the scope of the subject matter disclosed herein. For example, the locking and release mechanism may be or include a latch, a solenoid, a cable, etc., and may be released by contact, contact sensor, or contactless sensor.

In the embodiment illustrated in FIG. 5, when the weighted end of lever arm 500 is raised, and notch 506 disengages from pin 508, counterweight 120 and vertical support member 108 together move to the position shown using dotted lines. This causes vertical support member 108 to rotate so that shoulder position indicators 102A and 102B move from the first position to the second position, i.e., away from golfer G. However, other means may be used to cause vertical support member 108 to rotate in this manner, as shown in FIGS. 6 and 7.

Figure 6:
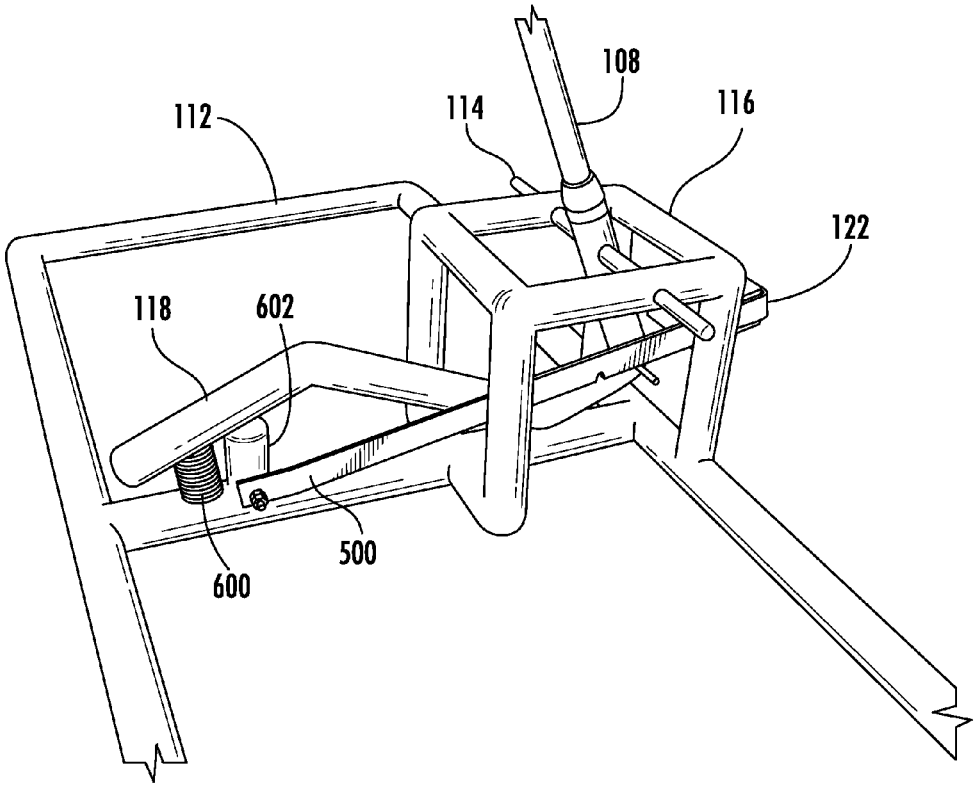
FIG. 6 is a detail view of an support structure which includes a spring actuator to move the shoulder positioning member from one position to another position according to another embodiment of the subject matter described herein.

FIG. 6 is a detail view of an support structure which includes a spring actuator to move the shoulder positioning member from one position to another position according to another embodiment of the subject matter described herein. In the embodiment illustrated in FIG. 6, when locking and release mechanism 122 is in its locked position, pin 508 is engaged in notch 506, but when locking and release mechanism 122 is released, pin 508 is no longer in notch 506 and vertical support member 108 may rotate around pivot axle 114. Tension spring 600 pulls down on tail 118 of vertical support member 108, causing vertical support member 108 to rotate into the position shown in FIG. 6. In an alternative embodiment, a compression spring may be used to push tail 118 or vertical support member 108 to cause vertical support member 108 to rotate into the position shown in FIG. 6. In an alternative embodiment, a torsion spring may be disposed on pivot axle 114 to provide rotational force to vertical support member 108. In one embodiment, the rotation of vertical support member 108 is limited by contact of tail 118 with a stop 602.

Figure 7:
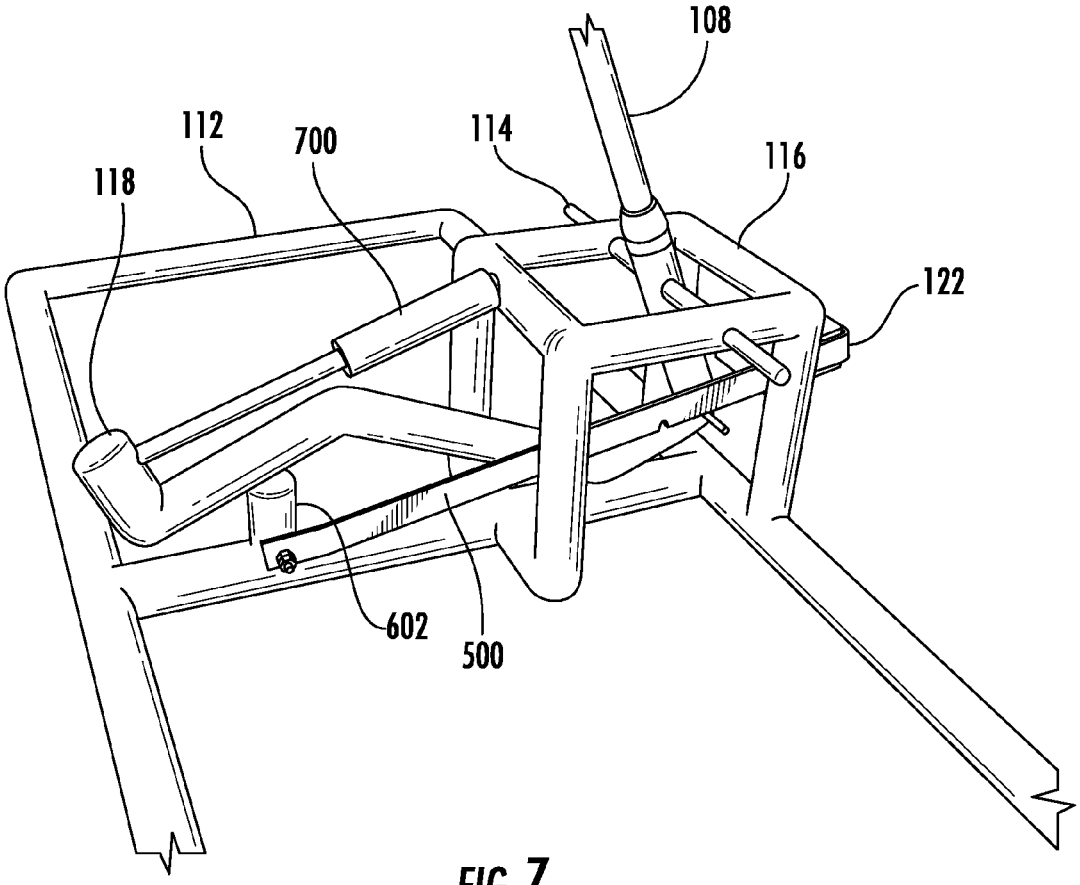
FIG. 7 is a detail view of an support structure which includes a pneumatic or hydraulic piston to move the shoulder positioning member from one position to another position according to yet another embodiment of the subject matter described herein.

FIG. 7 is a detail view of a support structure which includes a pneumatic or hydraulic piston to move the shoulder positioning member from one position to another position according to yet another embodiment of the subject matter described herein. In the embodiment illustrated in FIG. 7, for example, piston 700 may provide a downward force onto tail 118, so that when trigger and release mechanism 122 releases vertical support member 108, tail 118 is driven downward into stop 602, causing vertical support member 108 to rotate into the position shown in FIG. 7.

Figure 8:
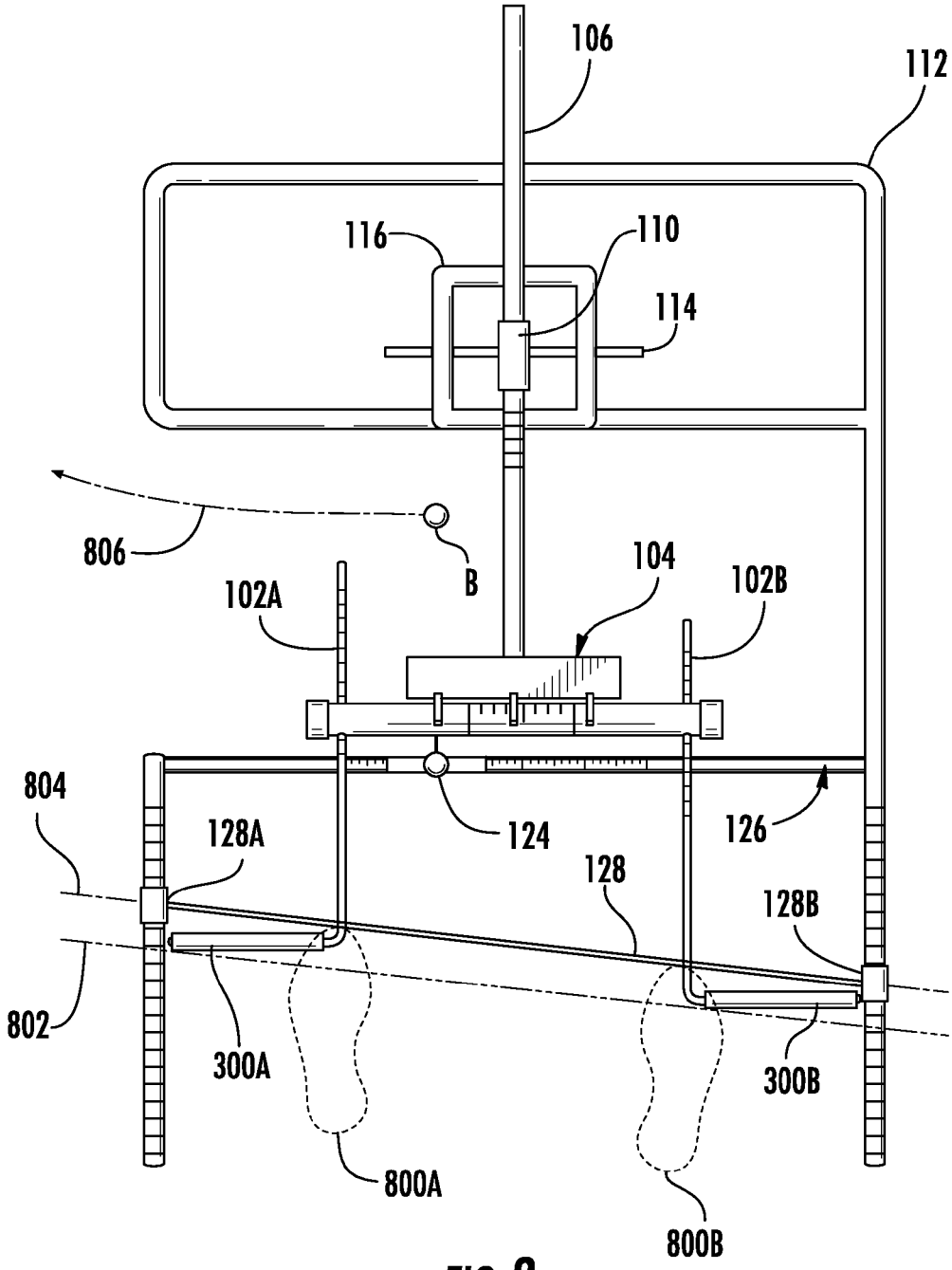
FIG. 8 is a top view of a golf training device according to an embodiment of the subject matter described herein, showing the components of the device adjusted for an example particular stance and position.

FIG. 8 is a top view of a golf training device according to an embodiment of the subject matter described herein, showing the components of device 100 adjusted for a particular stance and position. In the embodiment illustrated in FIG. 8, a "closed" stance is desired. The locations of the left and right foot 800A and 800B of golfer G are shown within base 112. The toes of the golfer's shoes are lined up with foot positioning indicator 128, which is adjusted to indicate a closed stance. The positions of shoulder position indicators 102A and 102B, and particularly of shoulder contact areas 300A and 300B, are adjusted to indicate the desired position of the golfer's left and right shoulder areas, respectively. Specifically, shoulder position indicator 102A is closer to ball B than is shoulder position indicator 102B.

In this configuration, it can be seen that the line 802 indicating the alignment of the golfer's shoulders as indicated by shoulder contact areas 300A and 300B is parallel to the alignment line 804 indicated by foot positioning indicator 128, but this need not be the case. Ball position indicator 124 is adjusted to show the desired position of ball B, which is toward the left foot 800A. In the embodiment illustrated in FIG. 8, yoke 104 has been adjust slightly to the right of the centerline defined by horizontal support member 106, e.g., the golfer leans slightly to the right in the stance prior to taking the swing. Although not visible in FIG. 8, yoke 108 may also be tilted such that shoulder contact area 300A is higher off of the ground than is shoulder contact area 300B. This configuration may be desired so that the intended trajectory 806 of ball B is a slight curve to the right relative to the forward motion of the ball.

It will be understood that any or all adjustable components of device 100 may include indicia, such as numbers, letters, index marks, and the like, that allow a user of the device to configure the device in a repeatable way. In one embodiment, a sliding member may include a scale to show position relative to a feature or location on another component. In one embodiment, dual or multiple scales may be present. For example, each end 128A and 128B of foot position indicator 128 may slide along members of base 112, where each member has both a first scale to show the position of end 128A or 128B relative to a first feature of base 112 such as track or groove 126, and also a second scale or index that allows each end 128A or 128B to be adjusted to match the respective distances of shoulder position indicators 102A and 102B, respectively, from yoke 104. In this example, a golfer may set shoulder position indicator 102A one inch closer to ball B than the other shoulder position indicator. To create the same alignment for the feet, the golfer would need to move end 128A more than one inch closer to ball B. Having a second scale for 128A with index marks designed to correspond to the index marks on shoulder position indicator 102A would allow golfer G to quickly set both the shoulder position indicators 102A and 102B and foot placement indicator 128 to the same angle relative to the ball.

Components that are adjustable may be adjustable to an infinite number of positions, or may be adjustable to a finite number of positions. An example of the latter includes sliding members that have detents or "peg and hole" structures, while an example of the former includes sliding or rotating members that may be secured in any position.

In one embodiment, device 100 may be configured to disassemble, fold, or otherwise articulate for movement or storage.

It will be understood that various details of the subject matter described herein may be changed without departing from the scope of the subject matter described herein. Furthermore, the foregoing description is for the purpose of illustration only, and not for the purpose of limitation.

What is claimed is:

1. A golf training device for indicating a proper stance, including posture and alignment, of a golfer who is positioned in preparation for hitting a golf ball prior to taking a swing, the device comprising:

a shoulder positioning member for indicating a desired stance of a golfer prior to taking a swing, including a desired position of each of the golfer's shoulders relative to at least one of the position of the ball and the intended trajectory of the ball; and a support structure for positioning the shoulder positioning member in a first position and a second position;

wherein, in the first position, the desired position of the golfer's shoulders is indicated by contact of the golfer's shoulder area with the shoulder positioning member;

wherein, in the second position, the shoulder positioning member is located away from the first position such that the shoulder positioning member does not interfere with the swing when it is taken and does not contact the golfer during the swing;

wherein the shoulder positioning member is moveable from the first position to the second position without requiring movement of the golfer's shoulders away from the desired position that was established prior to taking the swing; and wherein the device is adjustable to accommodate different sized golfers or different sized clubs used by a golfer.

2. The golf training device of claim 1 wherein the position of each shoulder includes at least one of:

the height of the shoulder from the ground;

the distance of the shoulder from the support structure;

the position of the shoulder relative to the ball;

the position of the shoulder relative to the intended trajectory of the ball; and the position of the shoulder relative to the golfer's feet.

3. The golf training device of claim 1 comprising a locking and release mechanism for locking the shoulder positioning member in the first position to provide resistance to movement of the shoulder positioning member while the shoulder positioning member makes contact with the golfer's shoulder area and for releasing the shoulder positioning member to allow movement of the shoulder positioning member from the first position to the second position and vice versa, wherein the golfer effects release of the shoulder positioning member without requiring movement of the golfer's shoulders away from the desired position that was established prior to taking the swing.

4. The golf training device of claim 1 wherein the shoulder positioning member comprises a first shoulder contacting surface for contacting the area of one of the golfer's shoulders and a second shoulder contacting surface for contacting the area of the other of the golfer's shoulders.

5. The golf training device of claim 4 wherein the first and second shoulder contacting surfaces are disposed at the end of the parallel legs of a generally U-shaped yoke, the base of the U being disposed at a distance from golfer's body such that the shoulder positioning member moves from the first position to the second position without requiring movement of the golfer's arms or head.

6. The golf training device of claim 4 wherein the shoulder positioning member comprises a horizontal support member for positioning the first and second shoulder contacting surfaces at a desired distance from the ball.

7. The golf training device of claim 6 wherein the horizontal support member has adjustable length.

8. The golf training device of claim 7 wherein the length of the horizontal support member is secured by a locking device.

9. The golf training device of claim 1 where the shoulder positioning member is configured to move from the first position to the second position by tilting, rotating, or translating from the first position to the second position.

10. The golf training device of claim 1 wherein the support structure is configured such that the golfer pushes the support structure, causing the shoulder positioning member to move from the first position to the second position.

11. The golf training device of claim 3 wherein the locking and release mechanism locks and releases the support structure, wherein golfer releases the support structure, and wherein, upon release of the support structure, the support structure moves the shoulder positioning member from the first position to the second position.

12. The golf training device of claim 1 wherein the support structure comprises a vertical support member for supporting the shoulder positioning member at a desired height.

13. The golf training device of claim 12 wherein the vertical support member has adjustable length.

14. The golf training device of claim 13 wherein the length of the vertical support member is secured by a locking device.

15. The golf training device of claim 12 wherein the support structure comprises a base for supporting the vertical support member.

16. The golf training device of claim 15 wherein the vertical support member is pivotally attached to the base.

17. The golf training device of claim 16 wherein the shoulder positioning member is moveable from the first position to the second position by pivoting the vertical support member away from the golfer.

18. The golf training device of claim 16 wherein the base includes a locking member for preventing the vertical support member from pivoting, wherein the golfer releases the locking member to allow the vertical support member to pivot, and wherein the golfer can effect release of the locking member without requiring movement of the golfer's shoulders away from the desired position that was established prior to taking the swing.

19. The golf training device of claim 1 comprising an actuating member for moving the shoulder positioning member between the first and second positions.

20. The golf training device of claim 19 wherein the actuating member comprises a weight or counterweight, a spring or elastic member, a hydraulic or pneumatic piston, or a motor.

21. The golf training device of claim 15 wherein the base includes a foot alignment indicator to indicate the position of at least one of the golfer's feet.

22. The golf training device of claim 21 wherein the foot alignment indicator comprises a bar or cord with which the feet of the golfer are aligned.

23. The golf training device of claim 22 wherein each end of the foot alignment indicator is positioned independently of the other whereby the foot alignment indicator indicates an open, closed, or square stance relative to a desired trajectory of the ball.

24. The golf training device of claim 15 wherein the base includes a ball location indicator to indicate a position of the ball prior to the swing.

25. The golf training device of claim 1 comprising indicia for reproducing at least one of the adjustments.

* * * * *